United States Patent [19]

Santoro et al.

[11] Patent Number: 4,973,050

[45] Date of Patent: Nov. 27, 1990

[54] PULLEYLESS WEIGHTLIFTING APPARATUS

[76] Inventors: John G. Santoro, 1900 Dant Blvd., Reno, Nev. 89509; Robert Webber, 620 K St., Sparks, Nev. 89431

[21] Appl. No.: 477,436

[22] Filed: Feb. 8, 1990

[51] Int. Cl.[5] ..... A63B 21/062

[52] U.S. Cl. ..... 272/117; 272/122; 272/123; 272/118

[58] Field of Search ..... 272/93, 117, 118, 122, 272/123, 134, DIG. 4

[56] References Cited

U.S. PATENT DOCUMENTS

| | | | |
|---|---|---|---|
| 3,294,399 | 12/1966 | Cugliari | 272/117 |
| 3,301,552 | 1/1967 | Ryan | 272/117 |
| 3,966,203 | 6/1976 | Bickford | 272/118 |
| 4,153,244 | 5/1979 | Tauber | 272/117 |
| 4,252,314 | 2/1981 | Ceppo | 272/117 |
| 4,256,301 | 3/1981 | Goyette | 272/123 |
| 4,420,154 | 12/1983 | Ramsey et al. | 272/118 |
| 4,441,706 | 4/1984 | Korzaniewski | 272/118 |
| 4,561,651 | 12/1985 | Hole | 272/117 |
| 4,564,194 | 1/1986 | Dawson | 272/123 |
| 4,700,944 | 10/1987 | Sterba et al. | 272/117 |
| 4,741,528 | 5/1988 | Church | 272/118 |
| 4,826,155 | 5/1989 | James | 272/123 |

FOREIGN PATENT DOCUMENTS 3528944 2/1987 Fed. Rep. of Germany ..... 272/123

*Primary Examiner*—Robert Bahr

[57] ABSTRACT

A pulleyless weightlifting apparatus including a pair of bases, a pair of counterweights, a pair of stop pins, a pair of cables and a pair of vertical tubular posts. Each vertical tubular post is bent into a "U" shape at its upper end and its lower end is attached to the respective upper ends of the pair of bases. Each of the counterweights are connected to one end of the respective pair of cables and are then inserted into the channels of the respective vertical tubular posts. The opposite cable ends are attached to connectors which are connected to a dumbbell cable harness or attachments on a barbell. The vertical tubular posts include a series of apertures to receive stop pins for providing a range of height adjustment for the counterweights which allow the weightbearing bar to be suspended at any desired elevated position. The upper "U" shape ends of the vertical tubular posts allow the cables to be moved in an ascending and descending direction without the use of pulleys. This weightlifting apparatus allows unrestricted movement of a weightbearing bar and provides safety to the user not available with other free weight systems.

12 Claims, 8 Drawing Sheets

PULLEYLESS WEIGHTLIFTING APPARATUS

FIELD OF THE INVENTION

This invention relates to weight lifting machines. In particular, this invention provides for a pulleyless weightlifting system which utilizes cables for facilitating the performance of various dumbbell and barbell free weight exercises and a method for preventing injury to a weightlifter during the performance of these exercises.

BACKGROUND OF THE INVENTION

Exercising apparatus and equipment have been developed that allow various weight lifting exercises. In the prior art, weight lifting equipment have been disclosed, including those in the following U.S. Pat. Nos.:

4,153,244 to Tauber Jr. disclosed a gymnasium type equipment consisting of a weight bar attached to a pair of slides that are supported on vertical posts for performing vertical lifting exercises of the weight bar. Strap pins are used to limit the downward movement of the weight on the vertical slide posts.

4,252,314 to L. Ceppo, a weightlifting device is disclosed including two upright members, a fixed weight carrying bar coupled to cylindrical members, in a frame having several uprights. The cylindrical members and upright members guide the weightlifting bar in a fixed vertical movement.

4,564,194 to Dawson, a weightlifting station is disclosed including a pair of guide posts, a barbell assembly, a sleeve telescoped over the weight bar and stop pins attached to the sleeve. During the vertical movement of an exercise the sleeve can be rotated to engage the stop pins in holes of the guide posts.

4,256,301 to Goyette, a weightlifting apparatus is disclosed comprised of a pair of laterally spaced upright posts for supporting a weighted bar, a slidable foot member, a bench to which the slidable member is attached, safety clamps and a wheeled pulley device. The weighted bar is connected by a strand to the foot member which allows a portion of the weight to be relieved by pushing on the foot member.

4,441,706 to Korzaniewski, a weightlifting exercising device is disclosed including a vertically disposed framework defined by a pair of parallel, vertical, channel-shaped side members interconnected at the top and bottom by square tubing. A weightlifting bar is contained within the upright channel members and receiving pins are placed within the apertures of the vertical uprights at a pre-determined point so the bar can not be moved below this height to protect the exerciser.

4,420,154 to Ramsey et al. is disclosed a weightlifting apparatus which includes a framework having a base, vertical support members which have a plurality of apertures, stop pins and an adjustment body within the slots of the vertical support members. A weightlifting bar is inserted between the slots of the vertical upright members. The adjustment means is set at a selected height to prevent injury to the weight lifter.

4,561,651 to Hole is disclosed a weightlifting machine which includes a weight arresting bar, a detachable weight pulling assembly, a pair of upright members, pair of base members, adjustment mechanism with manually adjustable latches at each end of a stop bar to engage passages formed in the upright frame members.

The stop bar limits the downward movement of the weights in order to prevent injury to the exerciser.

4,700,944 to Sterba et al. is disclosed an exercise equipment which has upright guide tracks, a detachable bar carriage, detachable weight carriage, a pulley apparatus, a rotating bar apparatus and safety catch. The weight carriage is suspended within the upright guide tracks and can be positioned at a predetermined height. The weightlifting bar contained within the bar carriage is moved in a fixed path within the slots of the upright guide tracks.

3,528,994 to Erbe, West Germany disclosed an exercise unit which includes dismantable holder rods, square-edge precision aluminum tubes, a jib arm, guide pulley arrangement and automatic locking supports. The weight bar is held in a defined vertical area and is moved in a fixed vertical direction. The bar has an automatic locking device which prevents the weight bar from descending on the weight lifter.

4,826,155 to James, a weightlifting harness apparatus secured about the chest of an exerciser. The harness structure is connected to a cable which extends over a pulley-block unit that allows an attendant to assist the exerciser during the performance of an exercise.

None of the above weightlifting systems provide a capability which allows unrestricted vertical or horizontal movement of dumbbells or a barbell without the use of pulleys and a means for performing various free weight exercises with the versatility and safety advantages of this particular weightlifting invention.

SUMMARY OF THE INVENTION

A principal object of the invention is to provide an apparatus which combines the features of a free weight apparatus and a safety constrained apparatus but which makes available new advantages in weight lifting over both types of apparatus taken separately.

A further object of the invention is to provide a pulleyless free weight exercise apparatus for preventing injury to a weight lifter from the crashing down of dumbbells or a barbell during the performance of any exercise.

Another object of the invention is to employ a cable system with counter weights, connectors, and stop pins which does not require any pulleys for movement of dumbbells or a barbell in various exercises and the need for any assistance.

Still a further object of this invention is to provide a means for suspending dumbbells or a barbell at a pre-selected height for any exercise and after the exercise is completed the dumbbells or barbells remain suspended at the pre-selected height so that the exerciser may again repeat the exercise without having to retrieve and reposition the weight bars at the desired starting position.

A still further object of this invention is to provide a safety system which limits the downward movement of dumbbells or a barbell to a pre-selected elevated position during any exercise.

It is a further object of this invention to allow unrestricted vertical and horizontal movement of dumbbells or a barbell during the performance of any exercise.

Another object of the invention is to allow the easy exchange of dumbbells with a barbell or vice versa without modification to the cable support system or the weightlifting apparatus.

Another object of this invention is to increase the versatility of the weight-lifting apparatus by attaching a subframe consisting of a vertical tubular post containing a cable and slider assembly which may be releasably attached to the upper transverse member, the lower transverse member and a bottom transverse member which allows the exerciser to perform pushdown and pulldown exercises.

Briefly, the invention comprises a weightlifting apparatus having a pair of bases, a pair of vertically oriented tubular posts containing a series of apertures and having their upper ends bent into a "U" shape, a pair of cables and each cable having one end attached to a counterweight and the other end attached to a connector for attaching to weight bars or a cable harness. The cable ends attached to the counter weights are inserted into the channels of the upper "U" shaped ends of the vertical tubular posts. A stop pin is inserted into an aperture of each of the vertical tubular posts at a pre-selected height in order to stop the upward movement of the counter-weights at the pre-selected height. This suspends the weight bars connected to the opposite cable end at the desired elevation to perform a particular exercise. The cables attached to the counter weights and the weight bars move independently and freely within the vertical tubular posts.

A further object of this invention is to provide a pulleyless free weight apparatus that can also be constructed of other materials that are of different size and shape and which is durable, compact, safe, easy to assemble and disassemble and will provide considerable versatility for performing free weight type lifting exercises.

BRIEF DESCRIPTION OF THE DRAWINGS

The above and other objects and features of the invention will become more readily apparent on examination of the following detailed description including the drawings in which like reference numerals refer to like parts.

DETAILED DESCRIPTION OF THE PREFERRED EMBODIMENT

Figure 1:
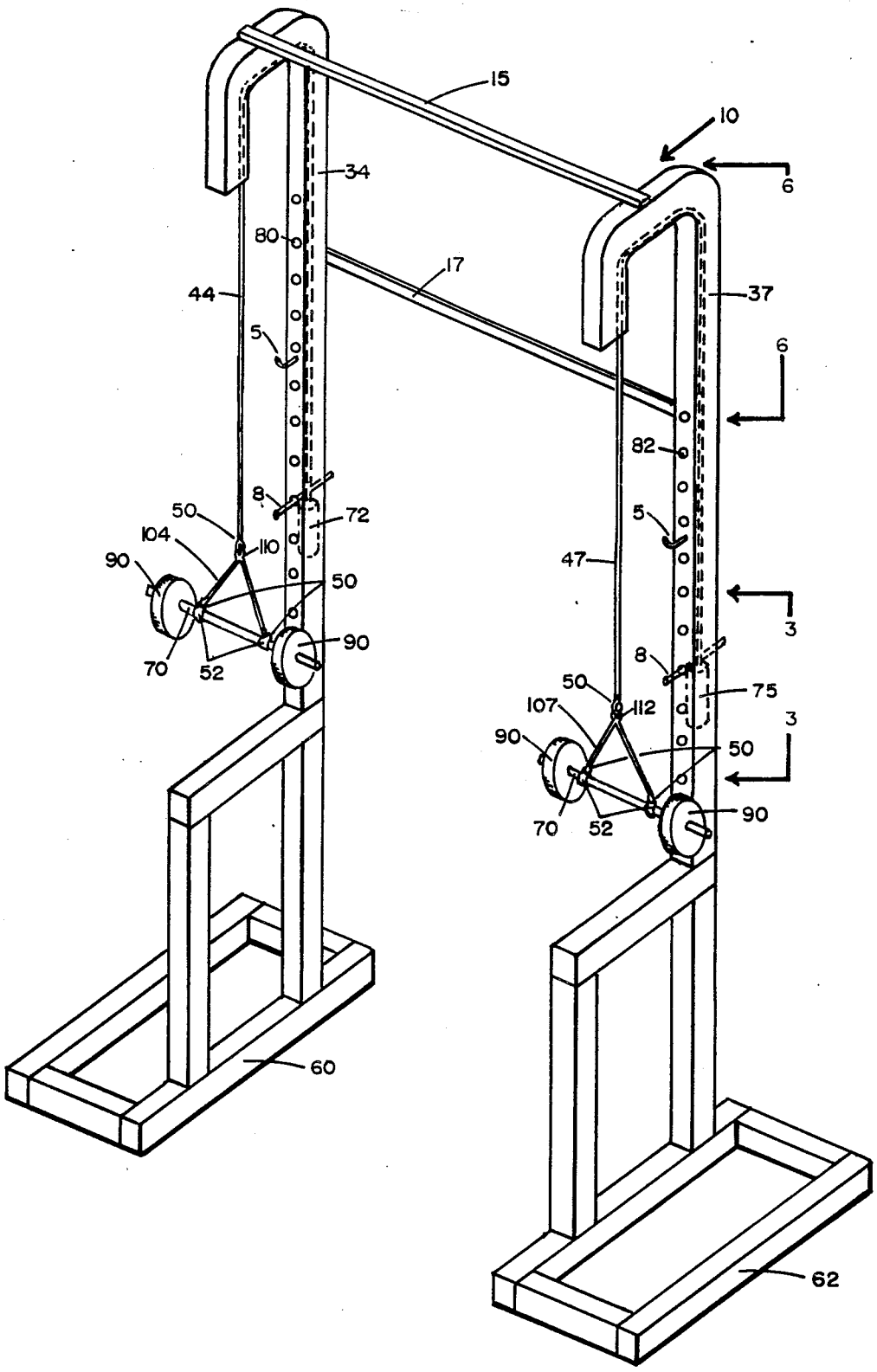
FIG. 1 is a perspective view of the invention with dumbbells.
Figure 2:
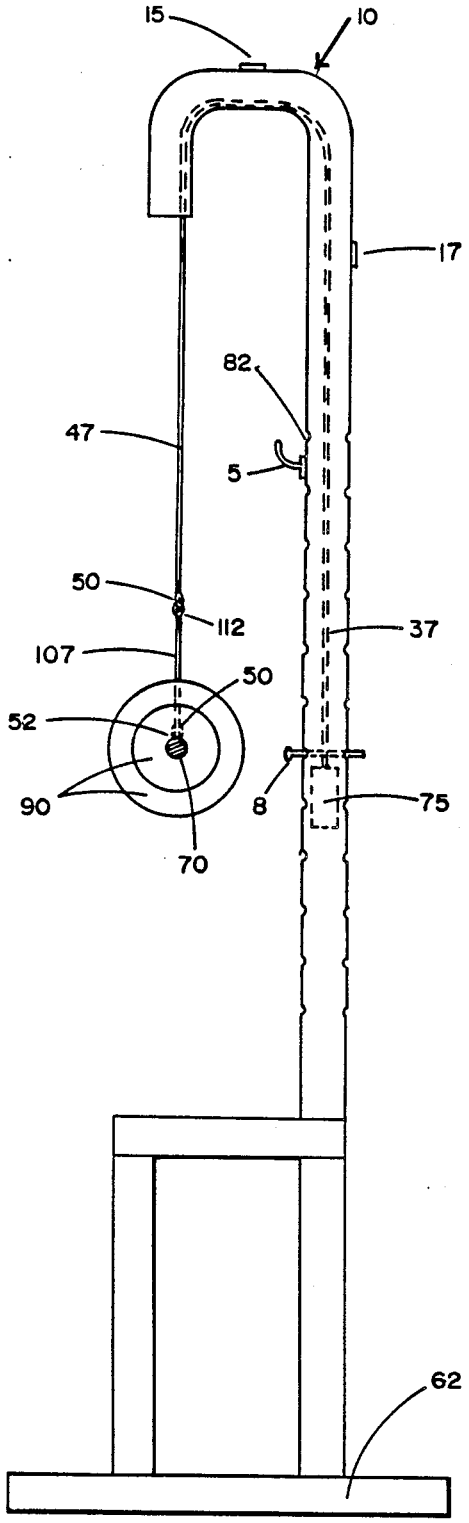
FIG. 2 is a side elevational view of the invention with dumbbells.
Figure 3:
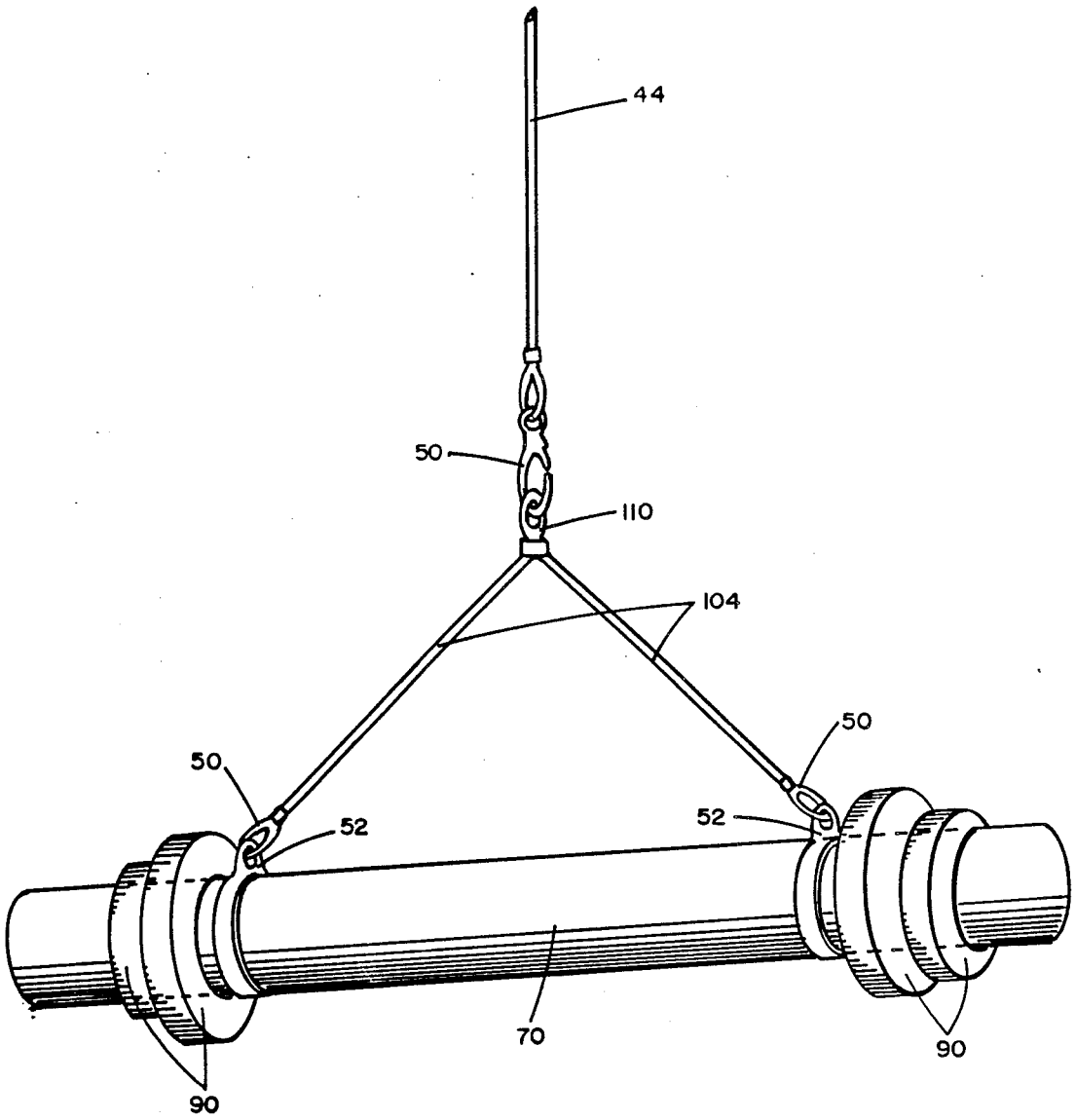
FIG. 3 is an enlarged view of one of the dumbbells and the cable harness associated therewith together with cable connectors, attachments, weight plates and cable.
Figure 4:
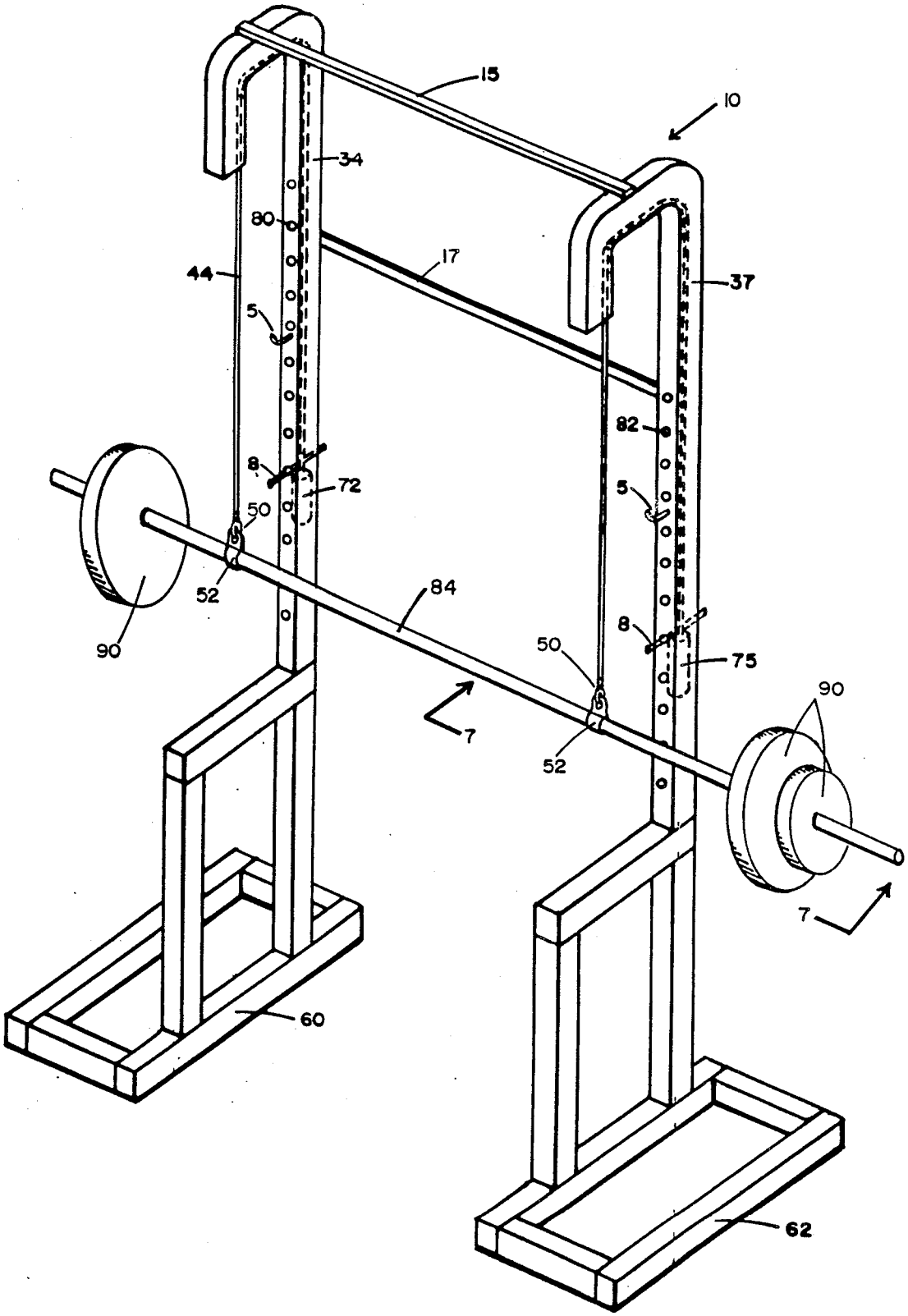
FIG. 4 is a perspective view of the invention with a barbell.
Figure 5:
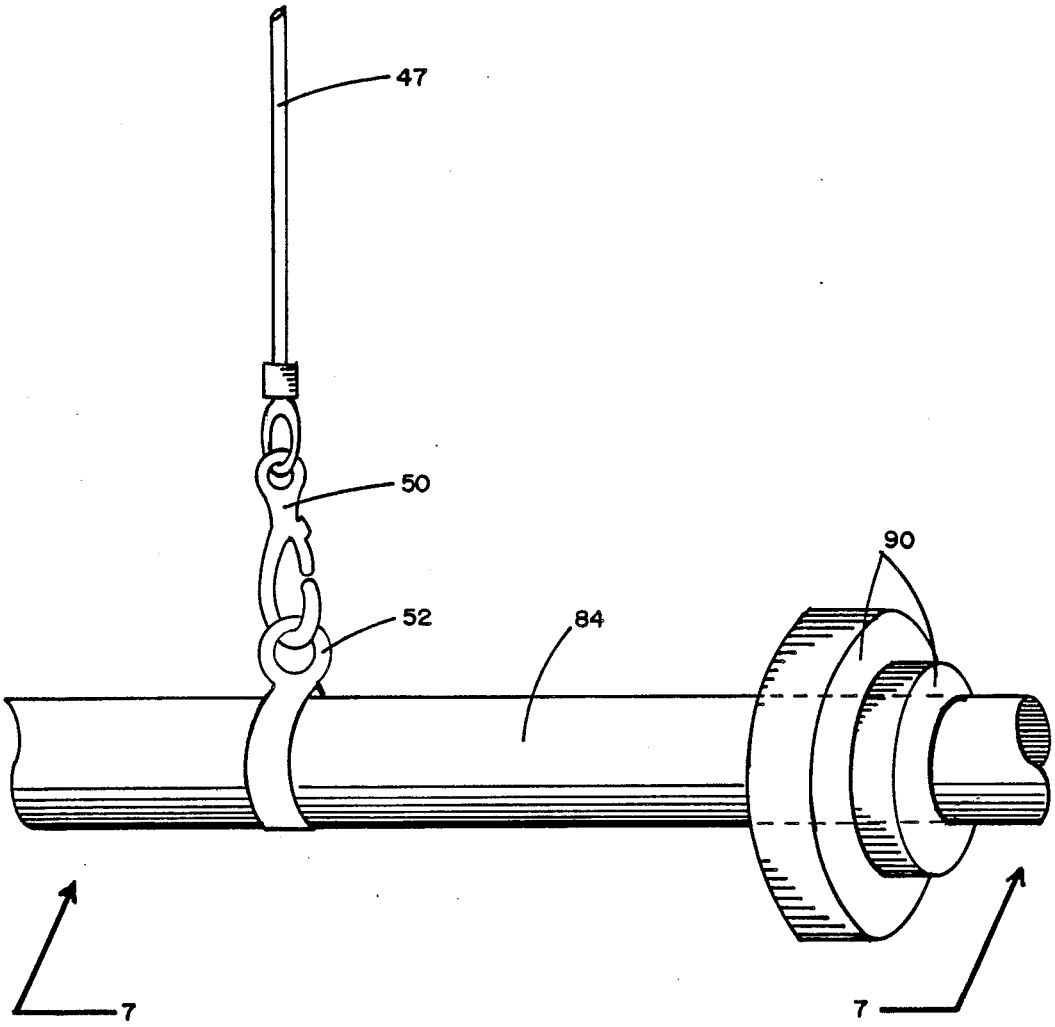
FIG. 5 is an enlarged, fragmentary detailed view of the barbell with weight plates, cable connectors, attachments and the cable taken along line 7—7 of FIG. 4.
Figure 6:
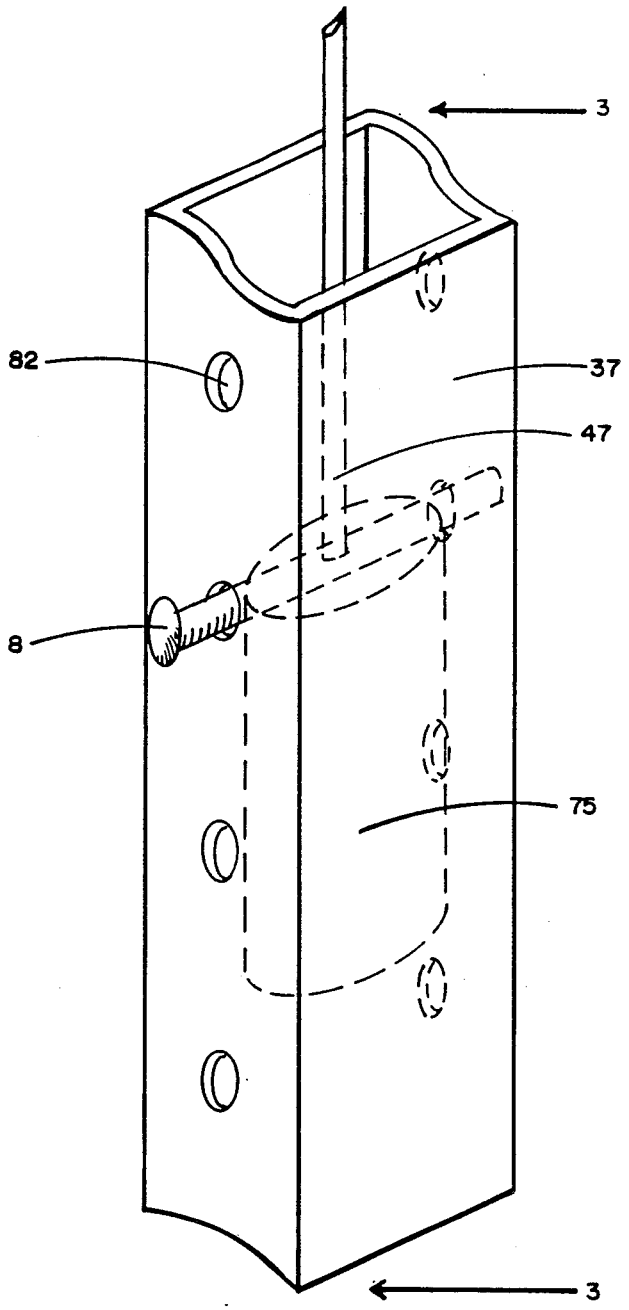
FIG. 6 is an enlarged, fragmentary perspective detailed view of the counter weight, cable and stop pin contained within one of the vertical tubular posts taken along line 3—3 of FIG. 1.
Figure 7:
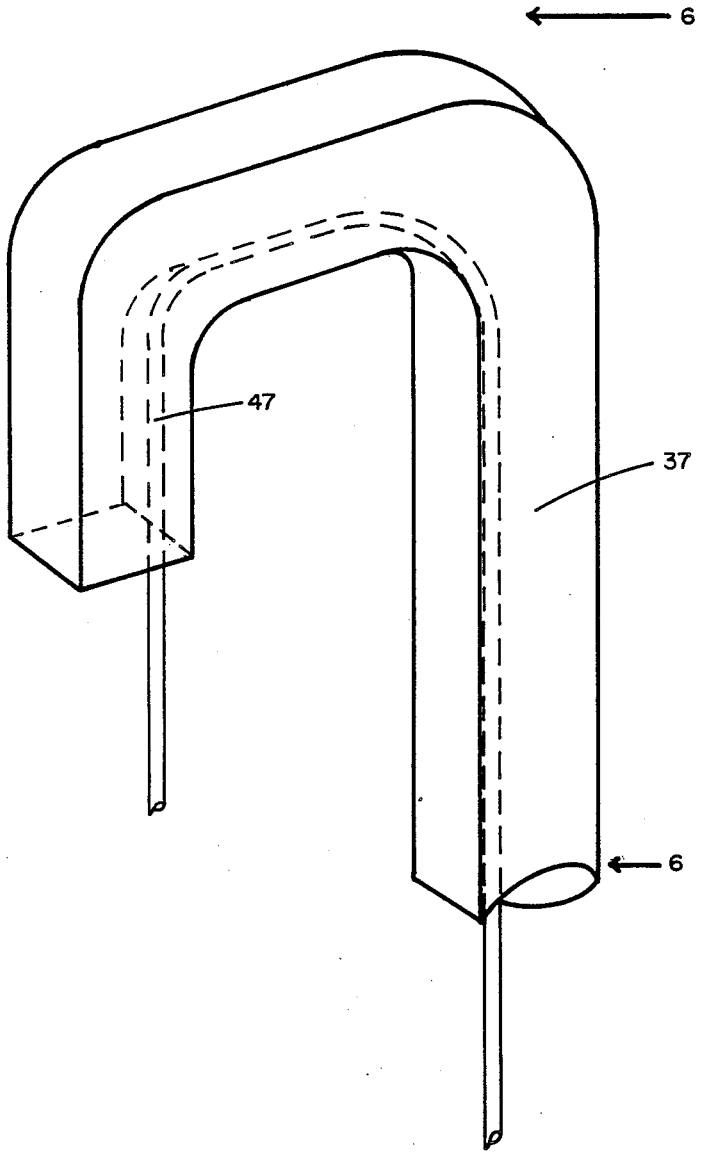
FIG. 7 is an enlarged, fragmentary perspective detailed view of one of the cables contained within one of the "U" shaped upper ends of the vertical tubular posts taken along line 6—6 of FIG. 1.

The present invention relates generally to an improved, weightlifting exercise device, where-in the improvements contribute to a variety of free weight lifting exercises capable of being performed and for preventing injury to a weightlifter from a weightlifting bar having weights thereon in the event of physical exhaustion and an exercise cannot be physically completed. Any exercise that requires the repetitious lifting of an exercise weight which totally exhausts the exerciser requires a "spotter" to assist the exerciser to safely complete the last forced repetition. The operational mode of this invention permits the exerciser to perform the last forced repetition without a "spotter" and without any danger of the exercising weight crashing down on the exerciser. Referring in detail now to the drawings, wherein like reference numerals designate similar parts throughout the various views, there is seen a pulleyless free weight exercising apparatus of the present invention as designated by reference numeral 10. The weightlifting apparatus 10 as shown in FIG. 1 and FIG. 4 has a pair of bases 60 and 62, a pair of vertical tubular posts 34 and 37 containing a series of apertures 80 and 82 and having their upper ends bent into a "U" shape, a pair of counter weights 72 and 75, an upper transverse member 15, a lower transverse member 17, a pair of cables 44 and 47, a pair of hooked brackets 5 welded to each of the vertical tubular posts 34 and 37 and a pair of stop pins 8 for insertion into apertures 80 and 82 of vertical tubular posts 34 and 37. The lower end of the vertical post 34 is attached to the upper end of the base 60 and the lower end of the vertical post 37 is attached to the upper end of the base 62. As shown in FIG. 1 and FIG. 4 the lower transverse bar 17 is interconnected to the spaced vertical tubular posts 34 and 37. The upper transverse bar 15 is interconnected to top of the "U" shaped end of the spaced vertical tubular posts 34 and 37. As shown in FIG. 1 and FIG. 4 the spaced vertical tubular posts 34 and 37 have a uniform, vertical series of apertures 80 and 82 respectively, transversely through the vertical tubular posts 34 and 37 and the apertures 80 in vertical tubular post 34 being in coaxial alignment with the apertures 82 in vertical tubular tower 37. One end of each of the cables 44 and 47 are connected to the counter weights 72 and 75 respectively, and the opposite ends of the cables 44 and 47 are attached to connectors 50. The counter weight 72 attached to one end of cable 44 is inserted into the channel of the upper "U" shaped end of the vertical tubular post 34 and the other counter weight 75 attached to cable 47 is inserted into the channel of the upper "U" shaped end of the vertical tubular post 37. For completeness sake, it should be noted that the exercise starting position for the dumbbell bars 70 or barbell 84 is determined by the adjustable stop pins 8. That is the stop pins 8 which are inserted into the pre-selected coaxially aligned apertures of vertical tubular posts 34 and 37 respectively, limit the upward movement of the counter weights 72 and 75 that are attached to one end of the cables 44 and 47 respectively and contained within the vertical tubular posts 34 and 37 respectively. This in turn limits the downward movement of the opposite ends of the cable 44 and 47. Prior to performing an exercise using a barbell 84 the barbell 84 is supported in an elevated position by hooked brackets 5 attached to the vertical tubular posts 34 and 37 respectively. The hooked brackets 5 extend outwardly from the tubular posts 34 and 37 so as to form a generally V shaped support for receipt of the laterally extending barbell 84 which is adapted to be weighted at opposite ends with weight plates 90. The hooked brackets 5 maintain the barbell 84 in a desired non-exercise position and allowing adding or exchanging of weight plates 90 without the barbell 84 tipping over when one end has a greater amount of weight. The exerciser sets up the apparatus 10 to perform a particular exercise with the dumbbell bars 70 or the barbell 84 by selecting a starting height at which he or she would feel most comfortable to begin the selected exercise by employing the following procedure. The end of the cables 44 and 47 with connectors 50 are lowered to the desired starting height for an exercise and the weight lifter approximates the height at which the counter weights 72 and 75 should be arrested by stop pins 8 to maintain the connectors 50 at the ends of cables 44 and 47 at the selected starting height for a particular exercise. Subsequently, a stop pin 8 is inserted through an aperture 80 of vertical tubular post 34 and a stop pin 8 is inserted through an aperture 82 of vertical tubular post 37 for arresting the counter weights 72 and 75 at the selected height in order to suspend the opposite ends of the cables 44 and 47 with the attached connectors 50 at the desired starting height for performing the selected exercise. If the weight lifter desires to perform dumbbell bar 70 exercises the ends of cable 44 and 47 which are attached to connectors 50 are connected to cable loops 110 and 112 of cable harnesses 104 and 107 respectively. The ends of cable harnesses 104 and 107 which are attached to connectors 50 are connected to attachments 52 connected to the dumbbell bars 70. If the weight lifter wants to perform barbell 84 exercises the ends of cables 44 and 47 which are attached to connectors 50 are connected to the attachments 52 connected to the barbell 84 which rests on the hooked brackets 5. The above described operational mode will suspend the dumbbell bars 70 or barbell 84 at the original selected exercise starting position and allow the weight lifter to perform repetitions or sets of an exercise with complete safety. During the performance of an exercise the exerciser has the freedom of resting between repetitions or sets of an exercise and can also repeat a repetition or another set of the same exercise without having to place the weighted dumbbell bars 70 or weighted barbell 84 on the floor since the weighted dumbbell bars 70 or weighted barbell 84 will remain suspended at the original starting height for the selected exercise. The invention allows the counter weights 72 and 75 connected to the ends of cables 44 and 47 to move freely in an ascending movement within the vertical tubular posts 34 and 37 respectively, up to the preselected height determined by the insertion of stop pins 8 into the respective apertures 80 and 82 of the vertical tubular posts 34 and 37. When the exerciser moves the weighted dumbbell bars 70 or the weighted barbell 84 that are attached to the connectors 50 on the ends of cables 44 and 47 in an upward direction from the selected exercise starting position the counter weights 72 and 75 connected to the ends of cables 44 and 47 respectively, descend freely within the channel of the vertical tubular posts 34 and 37. The "U" shaped upper end of vertical tubular posts 34 and 37 allow the other portions of the cables 44 and 47 located outside of the vertical tubular posts 34 and 37 to move freely in a vertical or horizontal direction without the need for pulleys.

Other known weight lifting apparatus which use pulleys with cables do not provide means for performing exercises with weighted dumbbell bars or allow the weighted dumbbell bars to be suspended at a preselected exercise height or prevent the weighted dumbbell bars from crashing down on the exerciser when a repetition can not be completed. The prior art weight lifting apparatus use pulleys with cables to perform only weighted barbell exercises and are restricted in their horizontal movement of the weighted barbell due to the cables having to be entrained in the grooves of the pulleys. Any extensive horizontal movement of a weighted barbell will cause the cables to come out of the grooves of the pulleys. The operational modes of the within inventive device are a noteworthy contribution to prior art devices, it is to be noted that an exerciser can safely perform exercises with the weighted dumbbell bars 70 or the weighted barbell 84, have unlimited horizontal and vertical movement of the weighted dumbbell bar 70 or the weighted barbell 84, perform forced repetitions or multiple sets in total safety and without the need of a "spotter" since the weighted dumbbell bars 70 or the weighted barbell 84 will remain suspended at the pre-selected starting exercise height whenever the exerciser releases the weighted dumbbell bars 70 or the weighted barbell 84.

Figure 8:
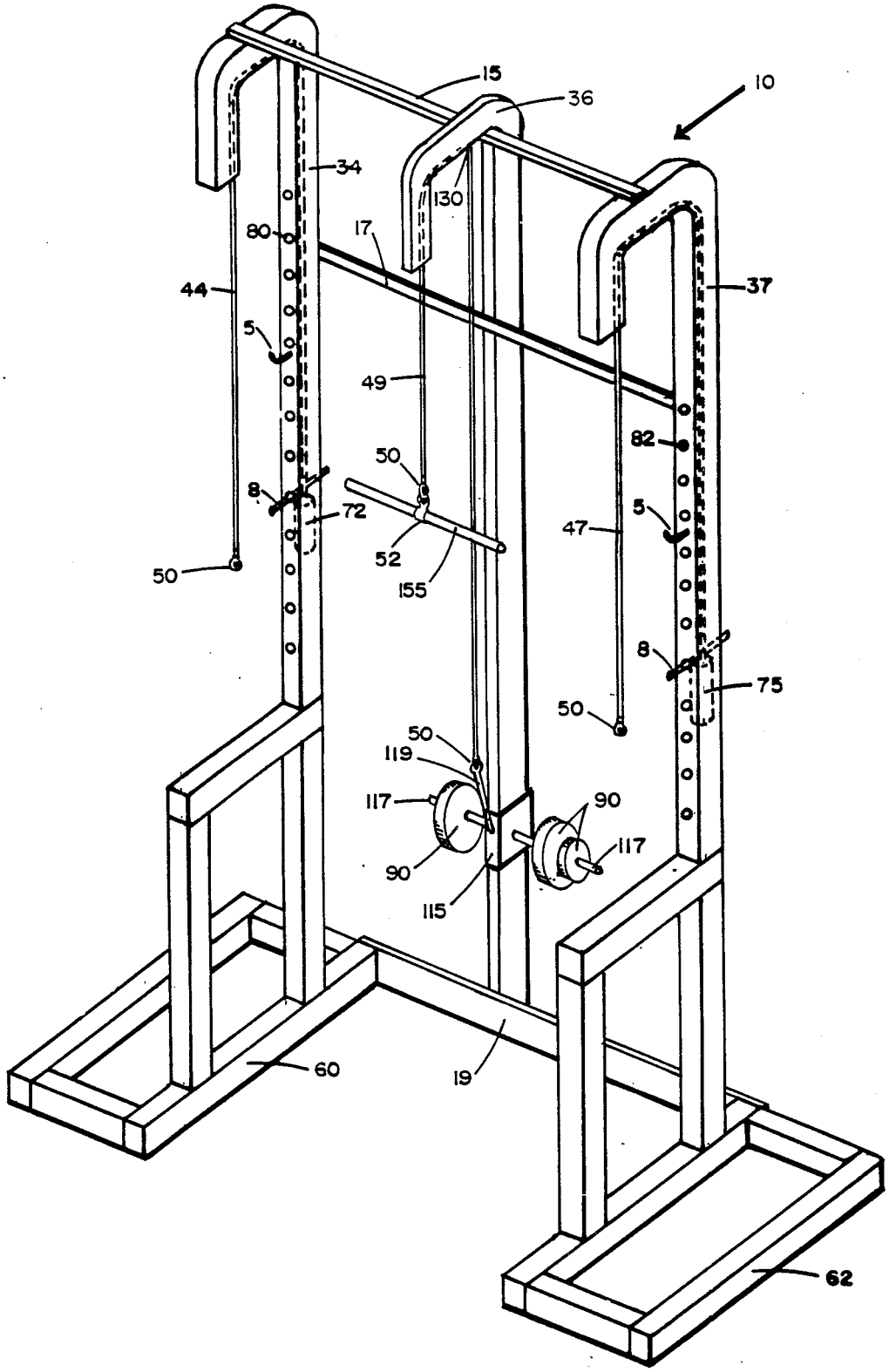
FIG. 8 is a perspective view of the invention with a detachable subframe attachment for performing pushdown and pulldown exercises.

Another optional use of the invention is shown in FIG. 8. A vertical tubular post 36 having its upper end bent into a "U" shape is attached to the centers of the lower transverse member 17 and upper transverse member 15 and the lower end of the vertical tubular tower 36 is attached to the center of the bottom transverse member 19. A slider assembly 115 is telescoped over the vertical tubular post 36. The slider assembly 115 is provided with a pair of weight bars 117 welded in a horizontal configuration to the sides of the slider assembly 115 in order to receive weight plates 90. The slider assembly 115 has a welded hook 119 that is attached to the connector 50 at the end of cable 49. The opposite end of the cable 49 is placed through an aperture 130 in the upper "U" shaped end of the vertical tubular post 36 and then extends downwardly through the opening of the "U" shaped upper end of the vertical tubular post 36 and is attached by connector 50 to the attachment 52 on the handle bar 155. The exerciser places a desired number of weight plates 90 on the weight bars 117 to perform a particular pushdown or pulldown exercise. To provide vertical movement of the slider assembly 115 the exerciser grasps the handle bar 155 and performs the selected exercise by pushing or pulling the handle bar 155 and the slider assembly 115 with weight plates 90 is moved in an ascending and descending direction along the vertical tubular post 36.

From the foregoing descriptions it should be readily appreciated as shown in FIG. 1, FIG. 2, FIG. 4, and FIG. 8 the inventive device 10 is adapted both by its construction and operational mode, to permit various embodiments and a wide range of weightlifting exercises.

This invention is not to be construed as limited to the particular forms, size and materials disclosed herein since there are to be regarded as illustrative rather than restrictive. It will be clear to those skilled in the art that various alterations, modifications, permutations and rearrangements of the materials and parts may be made without departing from the spirit and scope of the underlying inventive concept. A latitude of modifications, changes, and substitutions are intended in the foregoing disclosure and in some instances some features of the invention will be employed without a corresponding use of other features. Accordingly it is appropriate that the appended claims be interpreted as including such alterations, modifications, permutations and rearrangements as fall within the true spirit and scope of the invention herein.

What is claimed and desired to be protected by United States Patent is:

1. A pulleyless weightlifting apparatus for preventing injury to a weightlifter comprising:

a framework including a pair of laterally spaced base sections, a spaced vertical upright comprising a vertical tubular track support guide post extending vertically upwardly from each base section, said vertical tubular post having an upper "U" shaped end and a plurality of aligned apertures extending therethrough at regular intervals, an upper transverse member mounted to and extending between said upper "U" shaped ends of said vertical tubular posts, and a lower transverse member mounted to and extending between said vertical tubular posts;

a first and second cable harness;

a first and second dumbbell bar;

a first and second counter weight, one counter weight being slidably mounted within each vertical tubular post;

a pair of stop pins, one stop pin being removably insertable in said apertures of each said vertical tubular post, said stop pins extending through said vertical tubular posts and defining the upper limit of travel of said counter weight within said vertical tubular posts;

a first and second cable, said first cable having a first end connected to said first counter weight and said first counter weight being inserted into opening of said first upper "U" end of said vertical tubular post and having a second end connected to said first cable harness and said first cable harness connected to said dumbbell bar, said second cable having a first end connected to said second counter weight and said second counter weight being inserted into opening of said second upper "U" end of said vertical tubular post and having a second end connected to said second cable harness and said second cable harness connected to said dumbbell bar;

whereby said stop pins may be inserted into said vertical tubular posts at a predetermined location such that said stop pins will prevent the upward travel of said counter weight and thus prevent downward travel of said first and said second dumbbell bars below a second predetermined location.

2. The weightlifting apparatus as recited in claim 1 wherein the second end of each said cable is connected to each said cable harness and each said cable harness is connected to each dumbbell bar such that said dumbbell bars are suspended in a balanced horizontal position.

3. The weightlifting apparatus as recited in claim 1 wherein the second end of each said cable is removably connected to each of said cable harnesses.

4. The weightlifting apparatus as recited in claim 1 wherein each said dumbbell bar includes ends adapted to receive replaceable weight plates thereon.

5. A pulleyless weightlifting apparatus for preventing injury to a weight lifter comprising:

a framework including a pair of laterally spaced base sections, a spaced vertical upright comprising a vertical tubular track support guide post extending vertically upwardly from each base section, said vertical tubular post having an upper "U" shaped end and a plurality of aligned apertures extending therethrough at regular intervals, an upper transverse member mounted to and extending between said upper "U" shaped ends of said vertical tubular posts, and a lower transverse member mounted to and extending between said vertical tubular posts;

a weight bearing bar;

a first and second counter weight, one counter weight being slidably mounted within each vertical tubular post;

a pair of stop pins, one stop pin being removably insertable in said apertures of each said vertical tubular post, said stop pins extending through said vertical tubular posts and defining the upper limit of travel of said counter weight within said vertical tubular posts;

a first and second cable, said first cable having a first end connected to said first counter weight and said first counter weight being inserted into opening of said first "U" end of said vertical tubular post and having a second end connected to said weight bearing bar, said second cable having a first end connected to said second counter weight and said second counter weight being inserted into opening of said second "U" end of said vertical tubular post and having a second end connected to said weight bearing bar;

whereby said stop pins may be inserted into said vertical tubular posts at a predetermined location such that said stop pins will prevent the upward travel of said counter weight and thus prevent downward travel of said weight bearing bar below a second predetermined location.

6. The weightlifting apparatus as recited in claim 5 wherein the second end of each said cable is connected to points along said weight bearing bar such that said weight bearing bar is suspended in a balanced horizontal position.

7. The weightlifting apparatus as recited in claim 5 wherein the second end of each said cable is removably connected to said weight bearing bar.

8. The weightlifting apparatus as recited in claim 5 wherein the said weight bearing bar includes ends adapted to receive replaceable weight plates thereon.

9. A weightlifting apparatus for preventing injury to a weight lifter comprising:

a framework including a pair of laterally spaced base sections, a spaced vertical upright comprising a vertical tubular track support guide post extending vertically upwardly from each base section, said vertical tubular post having an upper "U" shaped end and a plurality of aligned apertures extending therethrough at regular intervals, an upper transverse member mounted to and extending between said upper "U" shaped ends of said vertical tubular posts, and a lower transverse member mounted to and extending between said vertical tubular posts;

a handle bar;

a bottom transverse member mounted to and extending between said base sections;

a vertical tubular support post extending upwardly from the center of said bottom transverse member, and attached to the center of said lower transverse member and the center of said upper transverse member, said vertical tubular post having an upper "U" shaped end, and an aperture underneath the said "U" shaped end;

a slider assembly being slidably mounted on said vertical tubular post, said slider assembly having a welded hook and weight bars welded to each side of said slider assembly;

a cable, said cable having a first end connected to said hook of said slider assembly and second end inserted through said aperture of said upper "U" shaped end of said vertical tubular post and having said second end connected to said handle bar thereof to enable said slider assembly to be vertically raised and lowered.

10. The weightlifting apparatus as recited in claim 9 wherein the second end of said cable is connected to a point along said handle bar such that said handle bar is suspended in a balanced horizontal position.

11. The weightlifting apparatus as recited in claim 9 wherein the second end of said cable is removably connected to said handle bar.

12. The weightlifting apparatus as recited in claim 9 wherein the said weight bars welded to said slider assembly includes ends adapted to receive replaceable weight plates thereon.

* * * * *